United States Patent [19]

Baker et al.

[11] Patent Number: 4,551,038

[45] Date of Patent: Nov. 5, 1985

[54] WRITING INSTRUMENT TIP

[75] Inventors: Hugh W. B. Baker, Beaconsfield; Graham J. Whiting, Stanford-in-the Vale, both of England

[73] Assignee: The Gillette Company, Boston, Mass.

[21] Appl. No.: 603,633

[22] Filed: Apr. 25, 1984

[30] Foreign Application Priority Data

May 6, 1983 [GB] United Kingdom ..... 8312584

[51] Int. Cl. ..... B43K 1/00; B43K 1/06

[52] U.S. Cl. ..... 401/265; 401/261; 401/199

[58] Field of Search ..... 401/261, 265, 266, 292, 401/196, 198, 199

[56] References Cited

U.S. PATENT DOCUMENTS

| | | | |
|---|---|---|---|
| 2,034,137 | 3/1936 | Fitz-Gibbon | 401/266 |
| 3,467,478 | 9/1969 | Webber | 401/265 X |
| 3,610,766 | 10/1971 | Herrnring | 401/265 |
| 4,215,948 | 8/1980 | Horie | 401/265 |
| 4,225,255 | 9/1980 | Braun et al. | 401/265 X |

FOREIGN PATENT DOCUMENTS

| | | | |
|---|---|---|---|
| 1561841 | 4/1970 | Fed. Rep. of Germany | 401/199 |
| 2108911 | 5/1983 | United Kingdom | 401/265 |

*Primary Examiner*—Steven A. Bratlie
*Attorney, Agent, or Firm*—Leonard J. Janowski

[57] ABSTRACT

A writing tip or nib for a reservoir pen is provided comprising a thin-walled hollow element (10), e.g. of metal, having an outwardly convex end wall portion (12) defining the writing surface of the tip, and several perforations (13) extending through the end wall portion for conducting ink directly to the writing surface from inside the tip. The perforations may be at least 8 in number and measure 50–200 microns across. The outer edges of the perforations are smoothly rounded at the writing surface and the perforations taper gradually inwardly from the writing surface.

15 Claims, 9 Drawing Figures

WRITING INSTRUMENT TIP

This invention concerns reservoir pens and relates in particular to novel forms of nibs or writing tips for a reservoir pen.

Various types of pen nibs have been proposed. The present invention seeks to provide a writing tip having good writing characteristics while permitting a wide freedom of choice as to the ink to be used, the kind of ink reservoir to be incorporated in the pen, and the overall pen design.

According to the invention, there is provided a writing tip for a reservoir pen, comprising a rigid, thin-walled element including a wall portion defining an external writing surface, and a plurality of perforations extending through said wall portion for conducting ink directly to said writing surface from the interior of the writing tip.

A writing tip in accordance with the invention may have a very smooth writing action on a surface, such as a sheet of paper being written upon. Furthermore, it can provide an efficient but controlled supply of ink to the writing surface of the tip so that the tip is able to lay down a continuous ink trace of uniform width. The writing surface of the tip is preferably convex, in which case the curvature of this surface may be selected to suit the line width desired. For example, the profile of the writing surface may have a radius in the range of 0.2 to 1.0 mm, and a radius of 0.5 mm has been found suitable for a pen using aqueous ink.

The element may be hollow and have any desired configuration, e.g. hemispherical, ovoid or generally pointed with a rounded end. Suitable materials for the element include metal, metallic alloy, resin, plastics, and reinforced plastics material.

It is preferable that several perforations, ideally more than eight, be provided in the element to constitute respective ink ports. Very satisfactory results have been obtained with tips incorporating 10 to 20 perforations.

According to one embodiment of the invention, the perforations are arranged according to a regular pattern centered on a central axis of the element. The shape, position, and size of the perforations are variable and can be selected to suit the type of ink and reservoir chosen, a particular writing angle and the required line width of the ink trace to be laid down by the writing tip. However, the perforations may have transverse dimensions preferably in the range of 50–200 microns and, more preferably in the range of 60–80 microns.

In order to improve the writing feel, the outer edge of each perforation can be smoothed-off or radiussed to eliminate any sharp edges at the writing surface which might snag on the paper and detract from the smooth writing feel.

To assist control of the ink supply, it is preferred that the perforations taper smoothly inwardly from the writing surface of the tip, and it can be expedient for each perforation to taper gradually through the full thickness of the element. In use ink is drawn through the perforations to the writing surface of the tip by the wicking effect of the paper being written upon. When the tip is lifted from the paper, the ink is pulled back into the perforations due to the capillary action which is enhanced by the inward tapering of the perforations.

One form of writing tip embodying the invention has the thin-walled element constituted by a hollow lamina with the perforations being confined to the wall portion which defines the writing surface. In another form of tip, the element comprises a foraminous layer, in particular a woven mesh which is preferably coated to unite the intersecting filaments of the mesh.

A better understanding of the invention will be had from the following detailed description which is given with reference to the accompanying drawings, in which.

Figure 1:
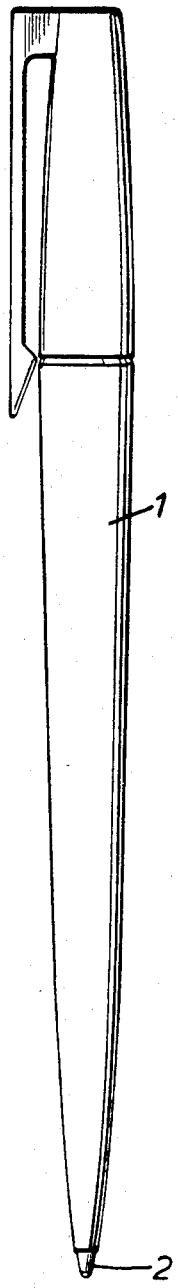
FIG. 1 shows a pen incorporating a writing tip embodying the invention.
Figure 2:
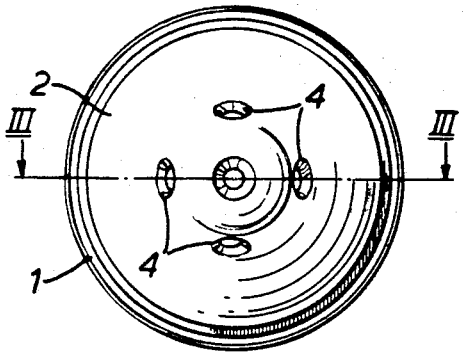
FIG. 2 is an enlarged scale end view of the writing tip of the pen.
Figure 3:
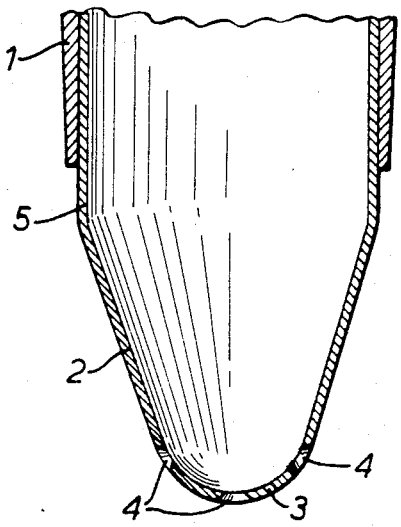
FIG. 3 is a partial section taken along the line III—III of FIG. 2.

The pen illustrated in FIGS. 1–3 has a barrel 1 into the forward end of which is fitted the writing tip 2. The tip takes the form of a rigid, thin-walled, hollow metal shell or element of circular cross-section with a cylindrical inner part sealed to the barrel 1, and an outer part shaped as a cone with a rounded end wall portion 3 which defines the writing surface. Five perforations are provided in this convex end of the tip and constitute respective ink ports 4 which are arranged according to a regular pattern with one centered on the axis and the remaining four spaced uniformly apart around a circle centered on the axis. The outer edge of each port is rounded off with a curvature which extends the full wall thickness of the shell, whereby the ports converge or taper smoothly and continuously from the outer writing surface to the inner surface of the hollow element. The ink ports 4 are substantially circular and have diameters of capillary dimensions, e.g. 60–80 microns, but it should be understood that the exact shape, size, number and arrangement of the ports may be varied according to particular requirements. In one possible modification at least some of the ports can be interconnected by narrow slits.

Confined within the barrel 1 and the hollow writing tip is an ink reservoir chamber 5 containing an ink carrier material, e.g. a fibrous material, a skeletal foam or a porous rubber or plastic material. Liquid ink is stored in the reservoir and when the curved writing surface 3 of the tip is applied to a sheet of paper, ink is drawn through the ports 4 and onto the paper by capillary attraction. The ink flow rate is influenced by the length of the ports, and the wall thickness of the hollow shell is chosen in accordance with the tip strength and ink flow requirements.

From the foregoing, it will be understood that the described writing tip allows a pen of simple construction having a hard-wearing writing point with long service life. The tip requires no moving parts yet achieves very good smoothness of writing, and imposes no constraints on the body or internal components to ensure maximum freedom of choice for the body design.

A variety of different inks and reservoir types and configurations are also possible. For example, a solid member could be accommodated within the tip and be shaped to define ink channels providing capillary flow to the tip ports from the ink reservoir.

Figure 4:
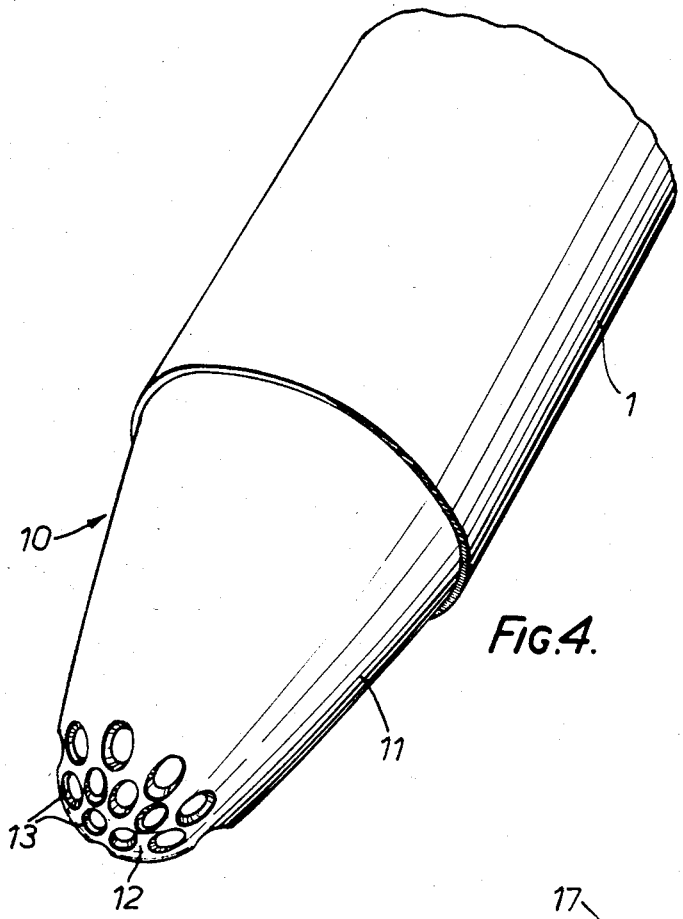
FIG. 4 is a perspective view of another writing tip according to the invention.

The tip shown in FIG. 4 is generally similar to that described above with reference to FIGS. 1–3. It comprises a rigid, thin-walled metal element 10 including a conical part 11 and a hemispherical end wall portion 12 which defines a convex writing surface of the tip. The wall portion 12 has nineteen perforations, 13 arranged according to a regular pattern centered on the tip axis, each of the perforations being substantially circular or elliptical in profile. The perforations constitute respective ink ports for supplying ink directly to the writing surface 12 of the tip from inside the tip.

Figure 5:
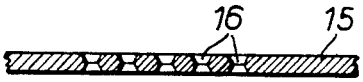
FIG. 5 is a section through a sheet of material used for making a tip as shown in FIG. 4.
Figure 6:
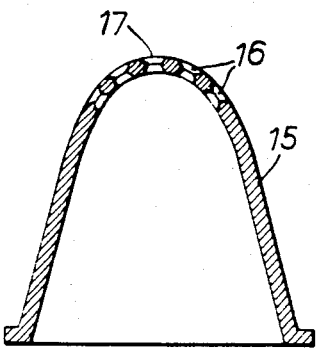
FIG. 6 is an axial section through a tip pressed out of the sheet of FIG. 5.

The tip of FIG. 4 may be made from a metal, e.g. stainless steel, sheet as shown in FIG. 5. The thin sheet of metal 15 is provided with perforations 16 arranged according to the pattern required in the final tip. The perforations may be produced by chemically etching the sheet either from that side which forms the outer surface of the finished tip, or from both sides in which case the perforations will taper slightly inwardly from both ends, as seen in FIG. 5, as a natural result of the etching process. The perforated sheet is then pressed into the required shape of the hollow element, as seen in FIG. 6, with the perforations located at the wall portion 17 defining the writing surface of the tip. During the pressing stage, the wall portion 17 becomes domed and the outer ends of the perforations become stretched or dilated while the inner ends are narrowed. There is also a tendency for the perforations at the edges of the portion 17, where the stretching of the material is greatest, to become elongated in the direction of the tip axis and hence slightly elliptical. Under the effects of the etching and pressing processes, the perforations taper smoothly inwardly from the outer surface of the tip. As a final step in the tip manufacture, the pressed tip is polished to remove the sharp edges at the outer ends of the perforations, e.g. by electro-polishing or by barrel polishing.

The tip shown in FIG. 4 may alternatively be made by electro-deposition of metal onto a previously prepared former. The former is made with a shape corresponding to that of the inside of the finished tip and is provided with holes at the same positions as the required perforations in the tip. These holes are made larger in diameter than the required perforations, e.g. about 150 microns in diameter for perforations of 60–80 microns diameter, and are filled with a non-conducting material. The former is plated with metal, e.g. nickel, to the required tip thickness in an electroplating bath. The finished tip is removed from the former having been formed in its final shape with the perforations in situ at the areas of non-conductive material. In addition, the perforations obtained by the plating process have smoothly rounded outer edges and taper gradually inwardly, as the perforations in the tip of FIG. 3.

Figure 7:
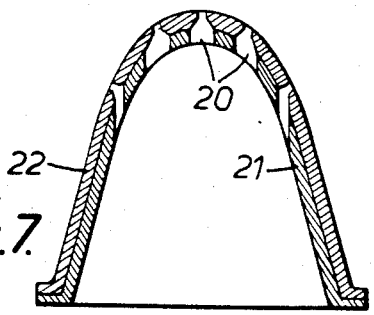
FIG. 7 is an axial section through a further writing tip embodying the invention.

A further method by which the tip of FIG. 4 may be made involves initially pressing a plane sheet of material into the required tip shape. Holes are then formed in the pressed sheet, for example by machining or by laser drilling, at the locations of the perforations. These holes are made slightly larger than the required diameter of the perforations. The outer surface of the pressed and drilled sheet is then electroplated e.g. with nickel. A tip formed by this process is shown in FIG. 7. It will be noted that the plating process has the effect of necking down the holes 20 in the pressed sheet 21 so that the resultant perforations have the required diameter. Furthermore, due to the well known Faraday cage effect, the perforations obtained have smooth edges at the outer surface of the plated layer 22 and taper smoothly inwardly from that surface. In order to avoid the plating step, it may be possible to produce tapering perforations directly in the pressed sheet by laser drilling, but in this case polishing will be necessary to remove any roughness left at the edges of the perforations as a result of the drilling process.

Figure 8:
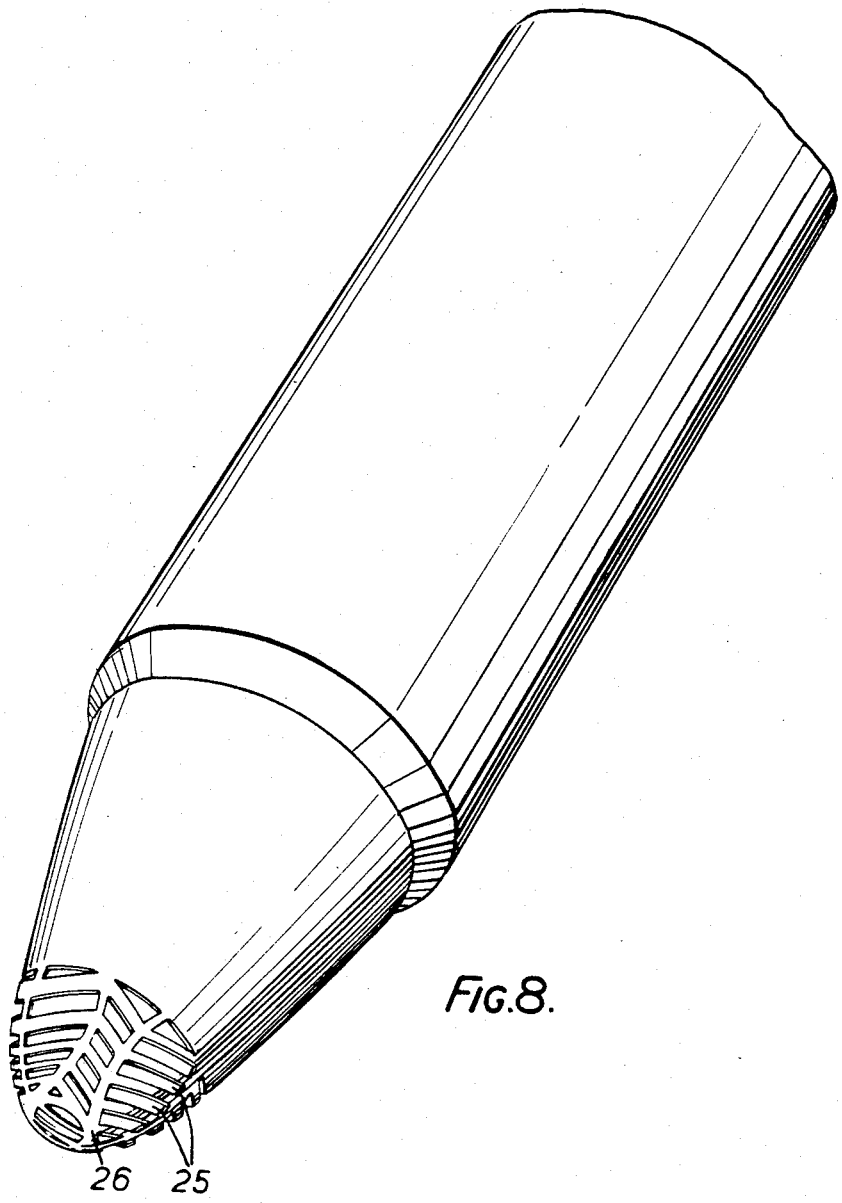
FIG. 8 is a perspective view illustrating a writing tip according to the invention and provided with slot-like perforations.

In the embodiments described above, the perforations have substantially circular or elliptical profiles. Other shapes are also possible, for example, in FIG. 8 there is shown a tip having perforations 25 of generally slot-like form whereby the writing surface 26 of the tip has a cage-like appearance. This writing tip could be produced by the etching and pressing method, or the electro-deposition method described above.

Figure 9:
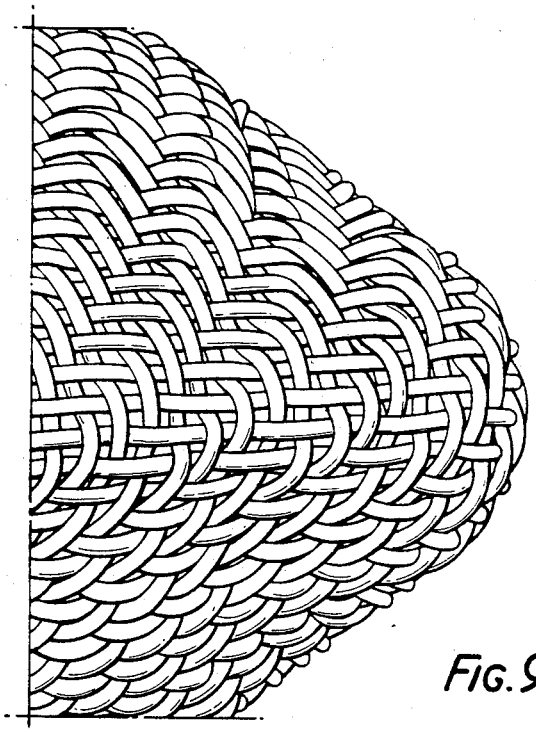
FIG. 9 is a side view showing the writing point of a tip according to the invention and formed from wire mesh.

A writing tip of entirely different construction to those described above is illustrated in FIG. 9. This tip comprises a rigid, thin-walled hollow element made from a fine wire mesh. The mesh comprises about 80 strands per cm. and the holes measure in the order 150 microns across the diagonal. The type of weave used in producing the mesh is not critical as far as the present invention is concerned. Other types of weave can also be used to equal effect in making writing tips embodying the invention. The flat mesh material is pressed into the desired tip shape, and the mesh is then electro-plated to fix the intersecting filaments of the mesh with respect to each other. In this way there is obtained a rigid tip with several perforations defining ink supply ducts opening at the writing surface of the tip.

A pen equipped with any of the above described writing tips will have good writing qualities, in particular with regard to smoothness in travelling over the paper being written upon and in the uniformity of the ink trace laid down with the tip. The ink trace will be substantially independent of the angle at which the pen is held relative to the paper and the direction of movement of the pen over the paper. Furthermore, the flow of ink to the writing surface of the tip will be cut-off immediately upon lifting the tip away from the paper due to the capillary action of the perforations drawing the ink back into the tip.

It is to be understood that the specific embodiments are described above by way of example only and modifications are possible without departing from the scope of the invention as defined by the following claims.

We claim:

1. A writing tip for a reservoir pen comprising a hollow, rigid, thin-walled element including a convex wall portion defining an external writing surface carrying more than eight substantially circular or elliptical perforations for conducting ink directly to the writing surface from the interior of the writing tip, said perforations having diameters between about 60 to about 80 microns and having transverse dimensions in the range of 50 to 200 microns and tapering smoothly inwardly from the writing surface and where the edges at the outer ends of the perforations are smoothly radiussed to thereby preclude snagging at the writing surface.

2. A writing tip as described in claim 1 wherein the number of perforations in said wall portion is 10–20.

3. A writing tip as described in claim 1 wherein said element comprises a pressed perforated sheet.

4. A writing tip as described in claim 1 wherein said element comprises a chemically etched perforated sheet.

5. A writing tip as described in claim 1 wherein said element comprises a perforated sheet formed in situ by electro-deposition of metal onto a former.

6. A writing tip as described in claim 1 wherein said element comprises a perforated sheet formed by pressing a plane sheet of material into the final tip shape.

7. A writing tip as described in claim 1 comprising a shaped sheet which has been electroplated on its outer surface after having been perforated.

8. A writing tip as described in claim 1 comprising a perforated sheet in which the perforations have been formed by laser drilling.

9. A writing tip as described in claim 1 in combination with an ink carrier material.

10. A writing tip as described in claim 9 in which said carrier material is selected from the class consisting of fibrous materials, skeletal foams, porous rubber, porous plastic material, and solid members shaped to define ink channels providing capillary flow.

11. A writing instrument comprising a barrel in combination with a writing tip as described in claim 1.

12. A writing instrument as described in claim 11 comprising in addition an ink carrier material and a liquid ink.

13. A writing instrument as described in claim 12 in which said ink is an aqueous ink and in which the writing surface of the tip is convex and has a radius of about 0.5 millimeters.

14. A writing tip as described in claim 1 in which the outer edge of each perforation is rounded off with a curvature which extends the full thickness of the wall whereby the perforations converge smoothly and continuously from the external writing surface to the inner surface of the tip.

15. A writing tip as described in claim 1 wherein the perforations have transverse dimensions of about 60–80 microns.

* * * * *